US005662052A

United States Patent [19]

McIntosh et al.

[11] Patent Number: 5,662,052

[45] Date of Patent: Sep. 2, 1997

[54] METHOD AND SYSTEM INCLUDING A DOUBLE ROTARY KILN PYROLYSIS OR GASIFICATION OF WASTE MATERIAL

[75] Inventors: Michael J. McIntosh, Bolingbrook; Gregory G. Arzoumanidis, Naperville, both of Ill.

[73] Assignee: United States Department of Energy, Washington, D.C.

[21] Appl. No.: 557,656

[22] Filed: Nov. 13, 1995

[51] Int. Cl.[6] ..... F23G 5/20

[52] U.S. Cl. ..... 110/346; 110/246; 110/229; 432/106; 432/108; 432/111; 432/117

[58] Field of Search ..... 110/226, 229, 110/246, 346; 432/105, 106, 108, 111, 117; 34/128, 130, 499, 503, 504

[56] References Cited

U.S. PATENT DOCUMENTS 4,262,429 4/1981 Avril ..... 34/128 X
5,207,009 5/1993 Thompson et al. ..... 432/108 X

*Primary Examiner*—Henry A. Bennett
*Assistant Examiner*—Susanne C. Tinker
*Attorney, Agent, or Firm*—Robert J. Fisher; Thomas G. Anderson; William R. Moser

[57] ABSTRACT

A method of destructively distilling an organic material in particulate form wherein the particulates are introduced through an inlet into one end of an inner rotating kiln ganged to and coaxial with an outer rotating kiln. The inner and outer kilns define a cylindrical annular space with the inlet being positioned in registry with the axis of rotation of the ganged kilns. During operation, the temperature of the wall of the inner rotary kiln at the inlet is not less than about 500° C. to heat the particulate material to a temperature in the range of from about 200° C. to about 900° C. in a pyrolyzing atmosphere to reduce the particulate material as it moves from the one end toward the other end. The reduced particulates including char are transferred to the annular space between the inner and the outer rotating kilns near the other end of the inner rotating kiln and moved longitudinally in the annular space from near the other end toward the one end in the presence of oxygen to combust the char at an elevated temperature to produce a waste material including ash. Also, heat is provided which is transferred to the inner kiln. The waste material including ash leaves the outer rotating kiln near the one end and the pyrolysis vapor leaves through the particulate material inlet.

20 Claims, 5 Drawing Sheets

METHOD AND SYSTEM INCLUDING A DOUBLE ROTARY KILN PYROLYSIS OR GASIFICATION OF WASTE MATERIAL

CONTRACTUAL ORIGIN OF THE INVENTION

The United States Government has rights in this invention pursuant to Contract No. W-31-109-ENG-38 between the U.S. Department of Energy and The University of Chicago representing Argonne National Laboratory.

BACKGROUND OF THE INVENTION

At the present time, there are only a few solid waste consuming facilities that produce a valuable product. Most of these are power plants which raise steam by burning the waste and thereby produce electrical energy. In a few other cases, heat is used to thermally decompose the solid waste into gaseous and/or liquid products (pyrolysis). While very few of these are in operation, others are under consideration or development, especially those which burn the incoming waste or a portion of the pyrolysis product to raise heat.

In general, waste pyrolysis processes can be subdivided into two classes. One class comprises those that require pretreatment of the waste feed, such as extensive grinding and/or pelletizing. Another class comprises those requiring little or no pretreatment. The pretreatment step is expensive, so the non-pretreatment class has an immediate economic advantage. Processes using rotary kilns or fluidized beds as pyrolysis reactors can be placed in the non-pretreatment class.

There are two main categories of rotary kilns: direct-fired and indirect-fired. Direct-fired kilns burn fuel inside the kiln. As a result, the waste material feed is exposed to combustion air. A portion of the pyrolysis product is burned, and the remainder becomes diluted with combustion product gas (i.e., flue gas). When pyrolysis products are diluted with flue gas, the downstream treatment units must be large to accommodate a large flow and are prohibitively expensive. Therefore, the direct-fired kiln is not applicable to pyrolysis.

Indirect-fired kilns supply heat to the waste material inside the kiln by exposing the outside of the steel or other suitable metal kiln to combustion. This is done relatively easily by burning fluid fuels (i.e., liquid and/or gaseous fuels) and impinging the flue gas on the outer surface of the kiln. However, fluid fuels are the more valuable of the pyrolysis products, while solid fuel (or char) is the least available. Therefore, solid fuels are the better economic choice for burning to raise pyrolysis heat. In order to use solid fuels, the kiln must be placed inside a solids-burning furnace. Such furnaces are expensive since they require solids handling, as well as combustion and ash collection equipment. The fluid fuel case thus has the advantage of simplicity but the disadvantage of consuming the more valuable fluid fuels. The solid fuel case has the advantage of utilizing solid fuels but the disadvantage of complexity due to solids handling.

There are two main categories of fluidized bed pyrolyzers: the single-bed and the double-bed. Single-bed pyrolyzers, like fluid-fueled kilns, are relatively simple but they cannot burn char. Double-bed pyrolyzers, like solid-burning kilns, can use solid fuels but they are more complex than the single-bed versions. The fluidized bed pyrolyzers have an additional disadvantage when considered for liquids production: the temperature and residence time for a given fluidized bed are fixed within relatively small ranges. However, for a given feed, the maximization of liquid yields requires some control over the time-temperature profile of pyrolysis products. Ideally, one would ask for complete temperature control of the pyrolyzer and rapid quenching of all pyrolysis products. This maximizes liquid product yield by reducing gas yield. The yield of the liquid product is further increased if the light liquid vapors can be passed directly to a condenser and, at the same time, longer residence at high temperatures can be provided for the heavier liquid (tars). It would be very difficult to attain this feature in a fluidized bed pyrolysis unit unless expensive tar collection, separation, and reinjection equipment were added. However, it is possible to do this in a rotary kiln, as will be discussed below.

Based on observations, an ideal reactor for waste pyrolysis to liquid product incorporates the following features:

1. Little or no pretreatment of feed required
2. Capability to burn solid fuels for pyrolysis heat without external solids handling
3. Indirectly fired so that combustion gas does not mix with pyrolysis product flow
4. Control over temperature-time profile of feed
5. Ability easily to return heavy tars to the pyrolysis zone The inventive pyrolysis reactor, which incorporates the above features, is described below. The reactor, the Double Rotary Kiln Reactor or DRK Reactor, can be used for pyrolysis or gasification of waste materials such plastics or other organic-based solids, or fuels such as coal, wood, oil shale, etc. Production of liquid and gaseous products such as fuels, synthetic crude oil or useful chemicals is possible depending on the settings of certain variable such as reactor temperature, feed rates and feed material(s), and the type of pyrolysis or gasification catalyst used. The DRK has similarities to those disclosed in the various patents, both Canadian and U.S., issued to William Taciuk, for instance U.S. Pat. Nos. 4,180,455; 4,260,879; 4,285,773; and 4,300,961. However, Taciuk's processor is different from the subject invention and does not have the coaxial alignment of feed inlet and combustion gas outlet of the present invention, nor do the Taciuk patents show the removal of pyrolysis gases through the inlet feed, an important feature of the present invention.

SUMMARY OF THE INVENTION

A new reactor for solids pyrolysis or gasification has been invented. It consists of two co-axial rotary kilns, inner and outer, welded together and turning at the same RPM. Solid waste enters the inner kiln and is pyrolyzed to char. The char drops to the outer kiln where it is combusted with air to produce pyrolysis heat. Pyrolysis product in vapor form and combustion gas are removed separately from the reactor. Solids move from front to back through the outer kiln via left-handed spiral flights while solids move from back to front in the inner kiln via right-handed spiral flights.

Accordingly, an object of the invention is to provide a method, apparatus and system for converting organic waste materials into commercially useful products, such as liquid fuels or chemicals such as chloromethane and cyclohexene.

Another object of the present invention is to provide double concentric rotating kilns wherein the solids and product vapors move counter-currently through the kilns in which product vapor exits through the product inlet.

Yet another object of the invention is to provide a method, system and kiln of the type set forth wherein an oxide catalyst is used to enhance the production of chemicals such as cyclohexene.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and may of its advantages should be readily understood and appreciated.

DESCRIPTION OF PREFERRED EMBODIMENT

Figure 1:
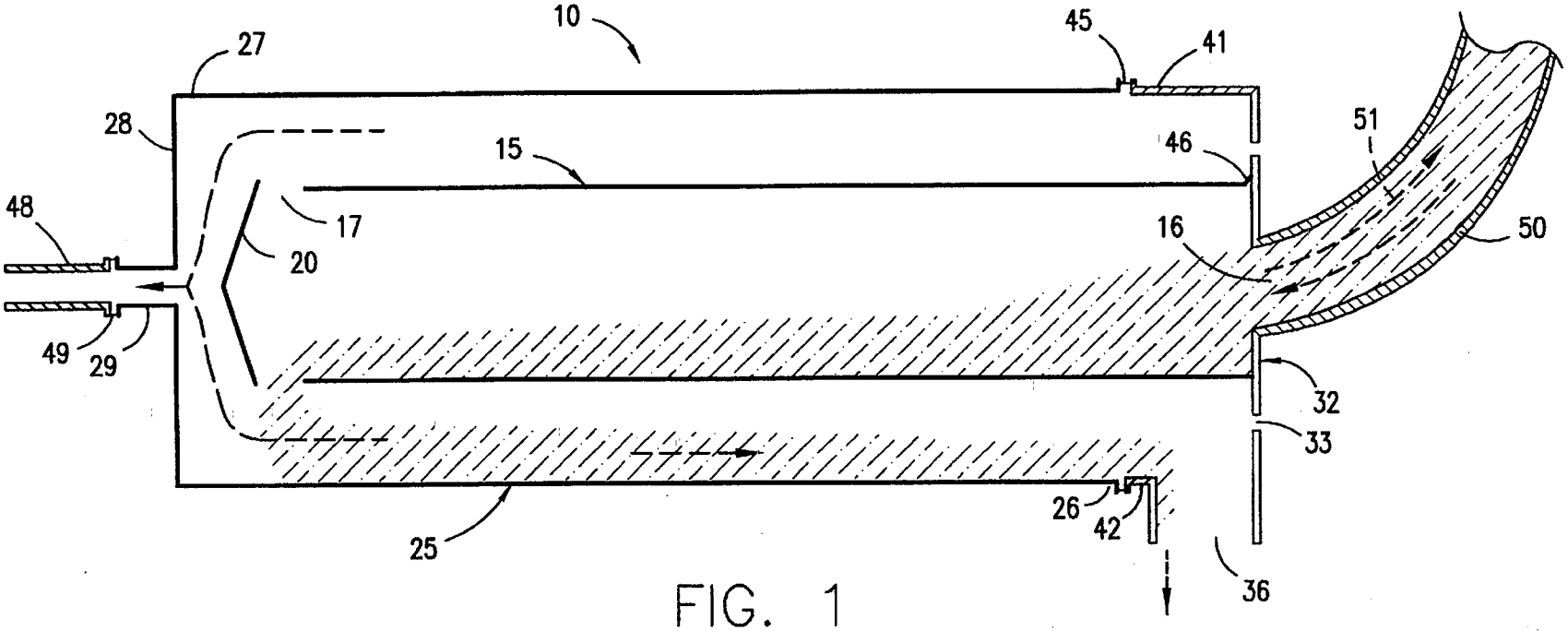
FIG. 1 is a schematic longitudinal cross sectional view of the double rotary kiln reactor.

Referring to FIGS. 1 through 4, there is disclosed a reactor 10 consisting of rotating concentric steel cylinders with an inner cylinder 15 and an outer cylinder 25. The cylinders or kilns 15 and 25 are coaxially arranged around a longitudinally extending axis of rotation, the inner cylindrical kiln 15 having an inlet end 16 and an outlet end 17. A baffle 20 is positioned down stream of the outlet end 17 of the inner kiln 15 and is in the shape of a cone 20. The outer cylindrical kiln 25 includes a rotating portion and a non-rotating portion. Of the rotating portion, there is an end 26 nearest the inlet chute or conduit 50 to be described and another end 27 having an end plate or wall 28 connected to a gas outlet 29. The portion of the outer cylindrical kiln 25 which extends downstream from the end 26 to the outlet conduit 29 rotates.

At the inlet end of the outer kiln 25 is a inlet end wall 32 which does not rotate and is provided with a circular array of tuyers or openings 33, for a purpose hereinafter to be described, and an ash and catalyst outlet 36. None of these parts rotate. The portion of the outer kiln 25 which does not rotate is completed by a longitudinally extending portion of the end wall 41 and a corresponding portion 42 extending from the outlet 36 longitudinally toward the outlet end of the reactor 10. Gas seals 45 are provided between the end of the outer cylinder 41, 42 which does not rotate and the portion 26 of the outer cylinder 25 which does rotate. Similarly at the outlet end, a gas seal 49 is provided between the rotating portion 29 of the outlet conduit and a non-rotating conduit 48 which is in fluid communication therewith. In addition, a gas seal 46 is provided between the end of the inner cylindrical kiln 15 and the end wall 32 which forms a stationary portion of the outer kiln 25.

Figure 5:
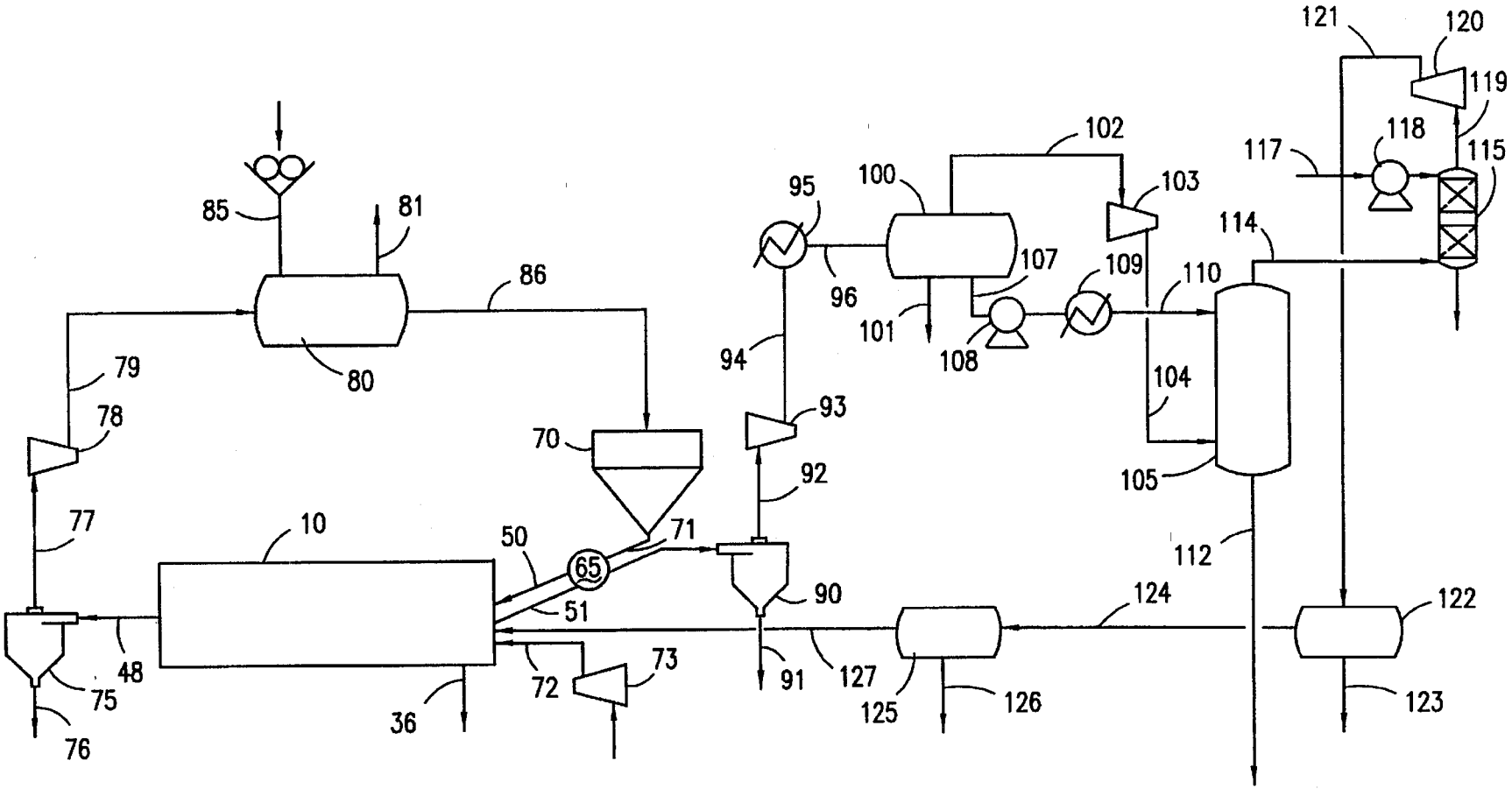
FIG. 5 is a schematic simplified process diagram for a DRK plant.

A particulate inlet or chute 50 connects the reactor 10 with a hopper 70, as illustrated in FIG. 5, and as will be explained hereafter, and a pyrolysis outlet vapor line 51 is illustrated on the process diagram of FIG. 5 but is illustrated more particularly in FIG. 1 by the dotted arrows which show that pyrolysis outlet vapor flows, within the interstices of particles, upwardly and outwardly of the reactor 10 through the inlet conduit 50 while fresh solid particles and condensed vapors along with catalyst flow downwardly and inwardly into the reactor 10 through the conduit 50.

Figure 3:
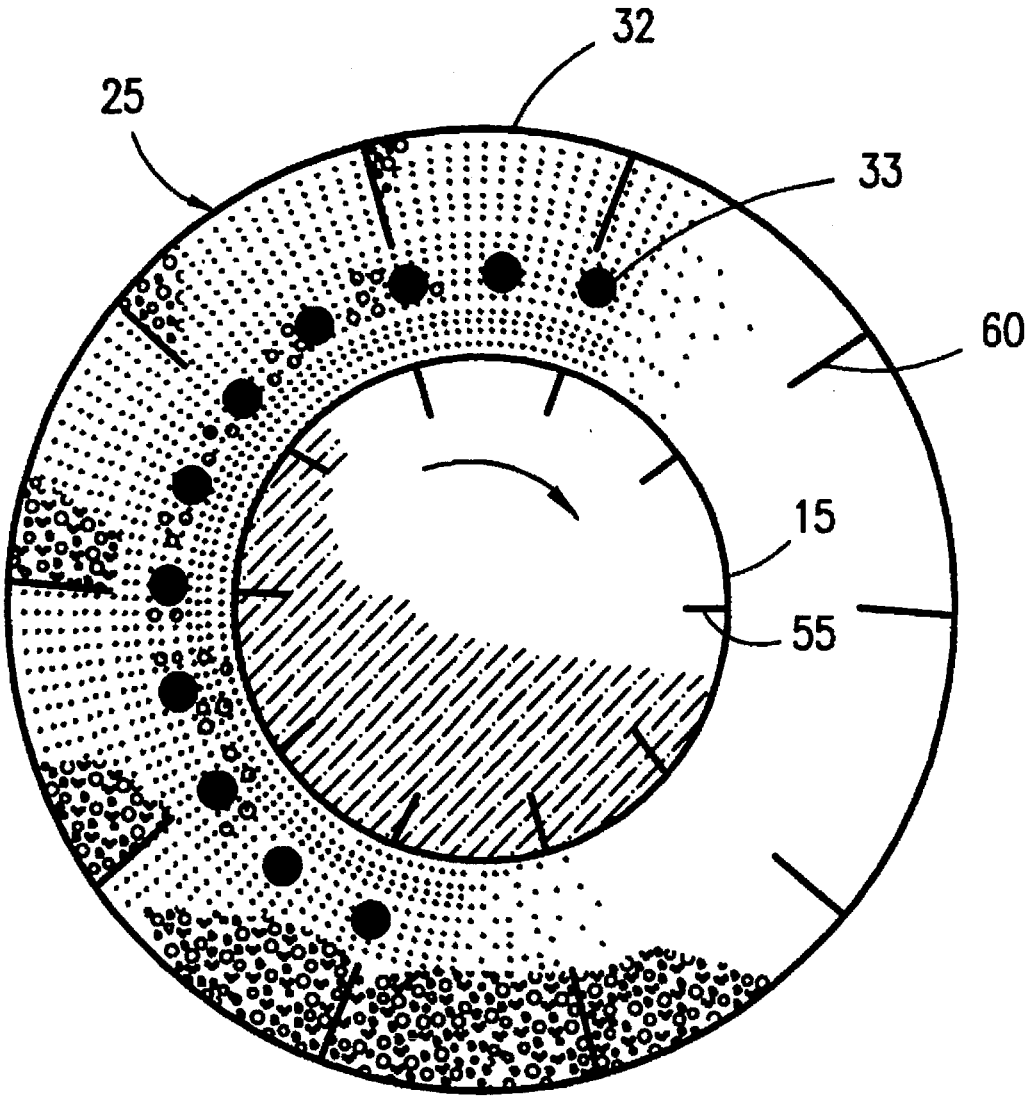
FIG. 3 is a view in cross-section of the double kiln reactor of FIG. 1 looking toward the right hand end cap.
Figure 4:
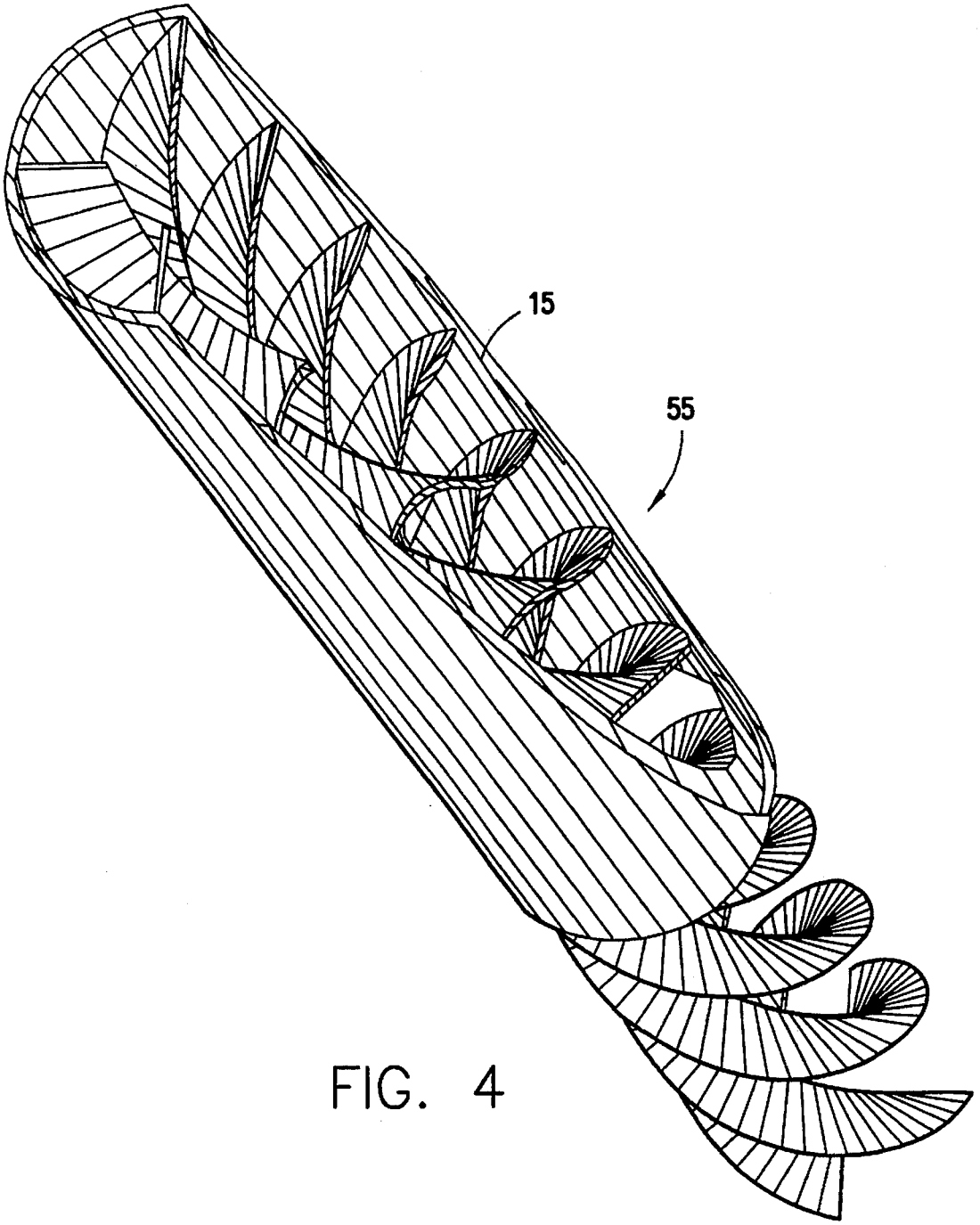
FIG. 4 is a schematic view, partially broken away, showing the inner kiln with spiral flights.

The inner and outer cylindrical kilns 15 and 25 are solidly welded together with cross braces (not shown) or ganged so that the two cylinders rotate together. The outer cylinder 25 is rotated by mechanism which is commonly used to rotate a single rotary kiln, and is well known in the art but is not shown herein for purposes of brevity. The inside surfaces of the inner kiln 15 and the outer kiln 25 are fitted with a right-handed spiral flight 55 and a left-handed spiral flight 60, respectively, in the inner and outer kilns. However, these may be reversed as is obvious to one skilled in the art. These flights 55 and 60 transport solids from the solid inlet 50 at the one end 32 of the cylinder 15 along the inner cylinder toward the other end of the reactor 10, that is toward the gas outlet conduit 29. At the other end of the inner kiln 15, the solids fall into an annular space defined by the inner kiln 15 and the outer kiln 25 as illustrated in FIG. 1 whereupon the spiral flights 60 as shown in FIGS. 2, 3 and 4 will transport the material to the right or toward the one end of the kiln 25.

Figure 2:
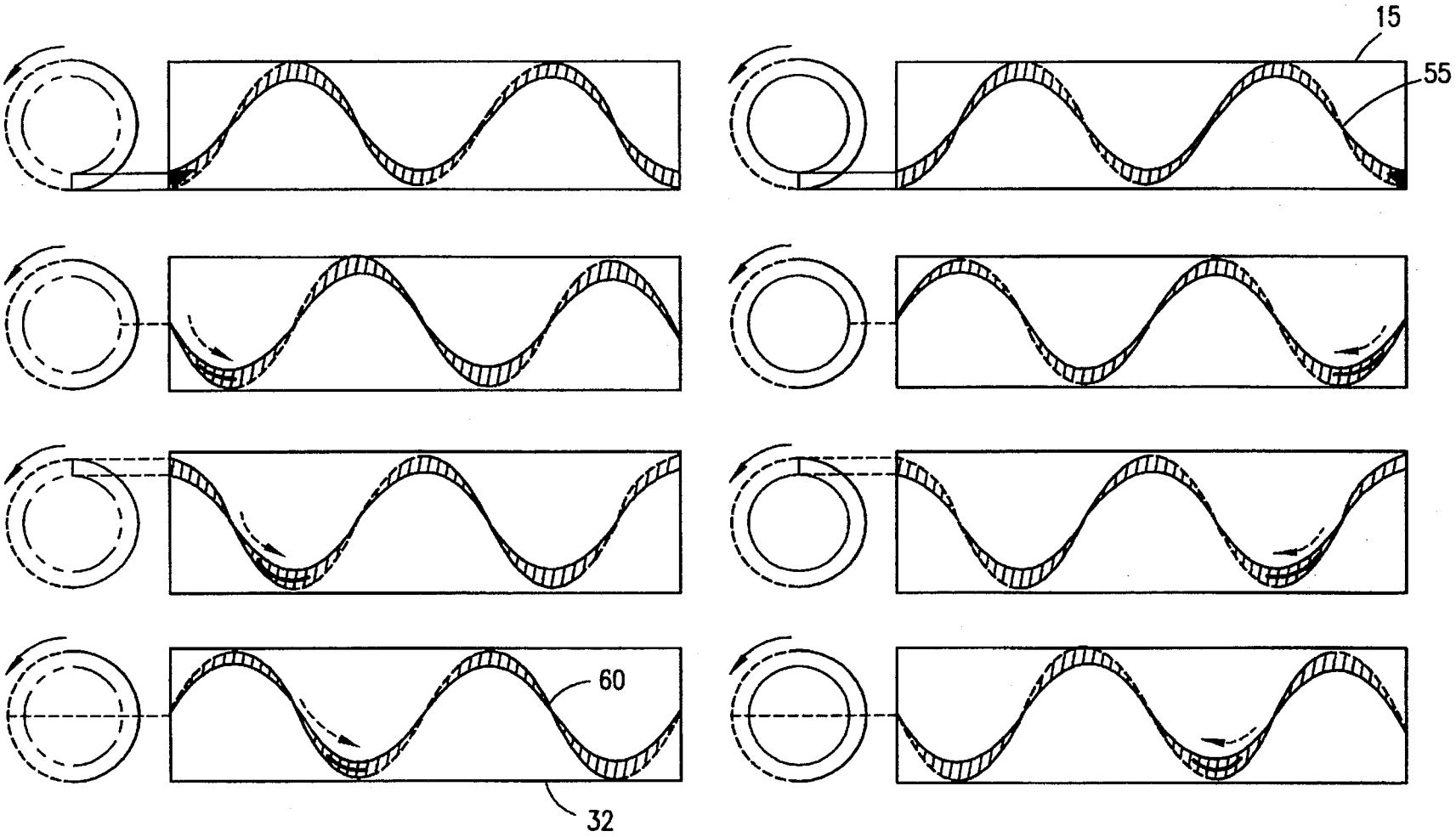
FIG. 2 is a schematic representation of the spiral flights in the reactor of FIG. 1 for moving the solids countercurrently to vapors.

More particularly, FIG. 2 shows the movement of material along the fights 55, that is from the right to the left as illustrated in FIG. 1, and movement of the material along the outer cylinder by the flight 60, that is from the left to the right as illustrated in FIG. 1. FIG. 3 is a view in cross section looking toward the end plate 32 and shows the position of the flights 55 and 60 on the inner and outer kilns 15 and 25, respectively. FIG. 4 is a perspective view partially broken away showing the spiral nature of the flights 55, 60 which provide significantly greater surface heating area than the paddles previously used in rotary kiln devices, particularly in the Taciuk devices referenced above.

For reasons hereinafter set forth, the pitch of the flights 55 and 60 is generally preferred to be within the range of from about 50° to about 30°. The pitch of the flights 55, 60 can be varied in order to control the residence time of particulates in various portions of the reactor 10. It is important, that the temperature at the inlet end of the reactor 10 be maintained in the range of from about 500° C. to about 1000° C. while the particulate material as it is transported from the inlet end toward the other end of the reactor 10 where it is transferred to the annular space between the inner and outer kilns 15 and 25 should be maintained in the range of from about 900° C. toward the inlet end to about 200° C. toward the outlet end.

As will be apparent, the particulate material is thereafter heated in the combustion zone which is in the annular space between the kilns 15 and 25 near the inlet end of the reactor 10 where air and perhaps some recycled gas with heating value is introduced through the tuyers 33 to provide a combustion zone near the entrance of the particulate matter into the inner kiln 15. In general, the residence time of the particulate material in the inner kiln from the inlet end to about midway through the inner kiln 15 is in the range of from about 5 to about 45 minutes depending upon the pitch of the spiral flight 55 and the RPM of the reactor 10.

The present invention has applicability to any organic residue which is in particulate form. It is preferred that the particulate form be such that the maximum average diameter of the particles be no greater than ½sth the diameter of the inner kiln 15 and, of course, because the pyrolysis reaction is a surface reaction, the finer the particulates the more efficient the pyrolysis. Oxygen is eliminated in the inner cylinder because the pyrolysis gasses are drawn off through the inlet conduit 50 by means hereinafter described which tends to remove any air entrained with the incoming particulates while they are being introduced into the reactor 15. Combustion gasses are drawn off through the conduit 29, by means hereinafter discussed, so as to prevent backup of combustion gasses into the inner kiln 15. The gas seal 46 prevents oxygen from entering the inner kiln 15 and as seen in FIGS. 1 and 3, the oxygen inlet through the tuyers 33 is always into the annular space between the inner kiln 15 and the outer kiln 25 so that air never gets into the pyrolysis zone in the front half of the inner kiln 15.

As before stated the invention is adapted to pyrolyze and destructively distill any organic containing material; however, the most preferred material to which this invention applies is automobile shredder residue. Automobile shredder residue (ASR) is that material which includes minimum metal but which includes most of the non-metallics in the automobile and therefore includes a variety of organic resins, wood, and the like. A typical synthetic ASR used in various laboratory experiments at Argonne National Laboratory is set forth below:

| Component | Weight % in Mixture |
|---|---|
| 1. Wood | 31.46 |
| 2. Glass reinforced polyester | 18.37 |
| 3. Tar | 15.74 |
| 4. Polyurethane foam | 10.48 |
| 5. Polypropylene | 8.89 |
| 6. PVC | 7.29 |
| 7. ABS | 3.65 |
| 8. Zytel | 2.06 |
| 9. Acrylic | 2.06 |

It has been found that including a particulate catalyst with the automobile shredder residue particulates in the pyrolysis zone along with a adjustment in the temperature of the material permits the chemical content of the product to be controlled. It has been found that using as a catalyst the oxides of zinc, aluminum and silicon in combination with controlling the temperature of the particulates in the inner kiln 15 enables the chemical composition of the product gasses, that is the pyrolysis vapor composition, to be controlled. More particularly it has been found that when the particulates are at a temperature in excess of 400° C., a vapor rich in cyclohexene is produced whereas when the particulates are maintained at a temperature in the range from about 300° C. to about 450° C. a vapor rich in chloromethane is produced. Moreover, it has been found that by drawing the pyrolysis vapor out through the fresh solids and catalyst inlet line or chute 50 high boilers such as tars and other high molecular weight vapors condense on the incoming particles which of course are at a lower temperature than the vapors and thereby are carried by the flowing fresh solids back to the inlet and reintroduced into the pyrolysis zone of the inner cylinder 15 for further treatment. The range of high molecular weight vapors that condense can be controlled by adjusting the pre-heat temperature of the fresh solids. This is a significant advantage over the known prior art.

As material flows through the inner kiln 15, the organic particles have become char because by the time they are discharged at the other end of the kiln 15 into the annular space between the inner kiln 15 and the outer kiln 25. The particulates are transferred to the right by the spiral flights 60 until they get in the combustion zone where the temperature becomes greatly elevated due to the burning or combusting of the char particles present in the waste material and a flue gas is produced which exits through the gas conduits 29 and 48 while the ash and catalyst particles now substantially free of char exit the reactor 10 through the conduit 36.

Referring to FIG. 5 of the drawings, there is disclosed a simplified process diagram showing the reactor 10 in a flowchart environment. As indicated, particulate matter such as automobile shredder residue or other organic residue is introduced into the reactor 10 through an inlet 50 from a vibratory feeder 65 connected to the hopper 70. A line 71 leads from the hopper 70 to the vibratory feeder 65 and then the line 50 introduces the material into the reactor 10. A line 51 is used to indicate flow of pyrolysis vapors out of the reactor 10 through the conduit 50 and hence for additional treatment as will be described.

Flue gas which exits through line 48 from the reactor 10 passes into a cyclone 75 wherein the solids are discharged to storage waste recycled to hopper 70 through a bottoms line 76 and vapor is passed through a line 77 into an exhauster 78. The exhauster 78 is a fan or other means by which flue gasses are drawn off of the reactor 10 through the outlet 29 and conduit 48. A line 79 connects the exhauster 78 with a preheater and dryer 80 from which exits the flue gas 81 which includes any water from newly introduced solids 85 entering the preheater 80 through a line 85. The dried solids are then transported from the preheater 80 through a line 86 to the hopper 70. Air for the combustion of the char in the reactor is introduced into the reactor 10 through a line 72 by means of a fan 73 connected to the atmosphere.

The pyrolysis vapor transferred through line 51 is directed to a cyclone 90. The cyclone 90 has a solid out line 91 to storage, waste or recycled to hopper 70 and a line 92 which conducts the overhead vapor from the cyclone 90 through an exhauster 93 via line 94 into a heat exchanger 95. The exhauster 93 serves to insure that pyrolysis vapor is exhausted from the inner cylindrical kiln 15 through the inlet line 50 so that the pyrolysis vapor can be then transmitted via line 51 for the treatment herein described. After heat is removed in the heat exchanger 95 the cooler material is transmitted via line 96 to a condenser 100. Additional heat is given up in the condenser 100 and water drops out through a line 101. Overhead gasses are transmitted through line 102 to an exhauster 103 via line 104 into the bottom of a fractionation tower 105. Lower temperature material leaves a condenser through line 107 is transported via a pump 108 through a heat exchanger 109 wherein sufficient heat is given up to transform the material into a liquid which is transferred via a line 110 into the top of the fractionation tower 105.

In the fractionation tower 105, a liquid product is taken off through line 112 after countercurrent contact with the vapor and an overhead vapor exits through line 114 into a hydrochloric acid treatment mechanism 115. Water is introduced into the hydrochloric acid treatment mechanism 115 through a line 117 via pump 118. An overhead line 119 conducts the vapor from the treatment mechanism 115 via a fan or exhauster 120 through line 121 into a holding tank 122. Water is removed from the gas in the accumulator or holding tank 122 via line 123 while fuel gas is transported through line 124 to a gas splitter 125 which produces a light gas product 126 for sale and a supplemental fuel gas is transmitted through line 127 into the reactor 10 for burning in the combustion zone with the air introduced through the line 72.

While there has been disclosed what is considered to be the preferred embodiment of the present invention, it is understood that various changes in the details may be made without departing from the spirit, or sacrificing any of the advantages of the present invention.

The embodiments of the invention in which an exclusive property or privilege is claimed are defined as follows:

1. A method of destructively distilling an organic material in particulate form comprising introducing particulate material through an inlet into one end of an inner rotating kiln ganged to and coaxial with an outer rotating kiln, the inner and outer kilns defining an annular space therebetween, maintaining the temperature of the wall of the inner rotary kiln at the inlet not less than about 500° C. to heat the particulate material in a pyrolyzing atmosphere to reduce the particulate material as it moves from the one end toward the other end, transferring reduced particulates to the annular space between the inner and the outer rotating kilns near the other end of the inner rotating kiln, transporting the reduced particles in the annular space from near the other end toward the one end in the presence of oxygen at an elevated temperature to produce a waste material including ash, transferring the waste material including ash from the outer rotating kiln near the one end, and removing pyrolysis vapor through the particulate material inlet.

2. The method of claim 1, wherein the temperature of the inner rotating kiln at the one end is maintained in the range of from about 500° C. to about 1000° C.

3. The method of claim 1, wherein the surface temperature of the particulate material is in the range of from about 900° C. to about 200° C. as the particles move from the one end toward the other end of the inner rotating kiln.

4. The method of claim 1, wherein the kilns are rotated at a speed such that the residence time of the particulate material from the inlet to about midway between the one end and the other end is in the range of from about 5 to about 45 minutes.

5. The method of claim 1, wherein air is introduced into the annular space near the one end and a gas seal is provided at the one end between the inner and outer kilns.

6. The method of claim 1, wherein the particulate material is automobile shredder residue.

7. The method of claim 1, wherein a particulate catalyst is commingled with the particulate material.

8. The method of claim 7, wherein the catalyst is a mixture of the oxides of zinc, aluminum and silicon.

9. The method of claim 1, and further removing combustion gases from the outer rotating kiln at the other end thereof.

10. The method of claim 1, wherein the particulate material has a maximum average particle diameter of 1/25 the diameter of the inner kiln.

11. The method of claim 1, wherein spiral flights extend internally along the inner kiln for transporting material from one end toward the other end during rotation of the kilns.

12. The method of claim 11, wherein the spiral flights are continuous.

13. The method of claim 1, wherein continuous spiral flights extend internally along the outer kiln for transporting material from the other end toward the one end during rotation of the kilns, the pitch of the spiral flights at the one end being flattened out to disperse the reduced particulates for more efficient burning.

14. The method of claim 13, wherein the pitch of certain of the spirals differs from the pitch of other of the spirals to control the residence time of waste material during transportation thereof from the other end toward the one end and are in the range of from about 30° to about 50°.

15. The method of claim 1, wherein the waste material includes combustion gases created during burning of the reduced particulates in the annular space and further including a combustion gas outlet in fluid communication with the outer kiln for transporting combustion gases from the outer kiln for cleaning.

16. A method of destructively distilling an organic material in particulate form comprising introducing particulate material through an inlet into one end of an inner rotating kiln ganged to and coaxial with an outer rotating kiln, the inner and outer kilns defining a cylindrical annular space therebetween and the inlet being positioned in registry with the axis of rotation of the ganged kilns, maintaining the temperature of the wall of the inner rotary kiln at the inlet not less than about 500° C. to heat the particulate material to a temperature in the range of from about 200° C. to about 900° C. in a pyrolyzing atmosphere to reduce the particulate material as it moves from the one end toward the other end, transferring reduced particulates including char to the annular space between the inner and the outer rotating kilns near the other end of the inner rotating kiln, transporting the reduced particles including char in the annular space from near the other end toward the one end in the presence of oxygen to combust the char at an elevated temperature to produce a waste material including ash and heat which is transferred to the inner kiln, transferring the waste material including ash from the outer rotating kiln near the one end, and removing pyrolysis vapor through the particulate material inlet.

17. The method of claim 16, wherein the pyrolysis vapor includes some high boiling point materials which condense on the incoming particulate material to be returned to the inner rotating kiln for further pyrolysis.

18. The method of claim 17, wherein the particulate material includes a catalyst which passes through the kilns and exits with the waste material and ash.

19. The method of claim 18, wherein the feed is ASR, including PVC and wood, and the catalyst is a mixture of the oxides of Zn, Al and Si and a temperature gradient in the inner kiln is established such that a vapor rich in cyclohexene is produced when the particulates are at a temperature in excess of about 400° C. and a vapor rich in chloromethane is produced when the particulates are at a temperature in the range of from about 300° C. to 450° C.

20. The method of claim 19, wherein the temperature gradient of the particulates in the inner kiln is between about 200° C., near the other end and about 900° C. near the one end, the residence time of the particulates in the inner kiln is in the range of from about 5 to about 45 minutes, air is introduced into the annular cylindrical space to combust char on the particulate material transferred from the inner kiln to the annular space, and a gas seal is provided at the one end between the inner and outer kiln to prevent air from entering the inner kiln.

* * * * *